US005592191A

United States Patent [19]

Tsuboyama et al.

[11] Patent Number: 5,592,191

[45] Date of Patent: Jan. 7, 1997

[54] DISPLAY APPARATUS

[75] Inventors: Akira Tsuboyama, Sagamihara; Katsuhiro Miyamoto, Hiratsuka; Atsushi Mizutome, Fujisawa; Hideo Kanno, Machida; Hiroshi Inoue, Yokohama; Kazunori Katakura, Atsugi, all of Japan

[73] Assignee: Canon Kabushiki Kaisha, Tokyo, Japan

[21] Appl. No.: 53,304

[22] Filed: Apr. 29, 1993

Related U.S. Application Data

[63] Continuation of Ser. No. 603,375, Oct. 26, 1990, abandoned.

[30] Foreign Application Priority Data

Oct. 27, 1989 [JP] Japan ..... 1-280318
Apr. 17, 1990 [JP] Japan ..... 2-100768

[51] Int. Cl.[6] ..... G09G 3/36

[52] U.S. Cl. ..... 345/97; 345/94

[58] Field of Search ..... 345/87, 94, 97, 345/50; 359/85

[56] References Cited

U.S. PATENT DOCUMENTS 4,748,444 5/1988 Arai ..... 340/765
4,938,574 7/1990 Kaneko et al. ..... 340/784
5,155,613 10/1992 Sakayori ..... 359/85

FOREIGN PATENT DOCUMENTS 62-165630 7/1987 Japan .

*Primary Examiner*—Kee M. Tung
*Assistant Examiner*—Matthew Luu
*Attorney, Agent, or Firm*—Fitzpatrick, Cella, Harper & Scinto

[57] ABSTRACT

A display apparatus includes a display panel having a matrix electrode arrangement of intersecting scanning lines and data lines, a driving voltage generating means for supplying voltages to be applied to scanning lines to a scanning line driving means for driving scanning lines, as well as voltages to be applied to data lines to a data line driving means for driving data lines, at least one voltage level being supplied to the scanning and to the data line driving means, a switching means for turning on or off an electrical connection between the driving voltage generating means to a power source for supplying or disconnecting power to the driving voltage generating means, and a control means for controlling the scanning line driving means and the data line driving means such that a scanning signal voltage is applied to a scanning line to scan the same while a data signal voltage corresponding to image data is applied to a data line when the switching means is on, such that the one voltage level is supplied to the scanning line driving means and to the data line driving means after the switching means is turned off.

12 Claims, 9 Drawing Sheets

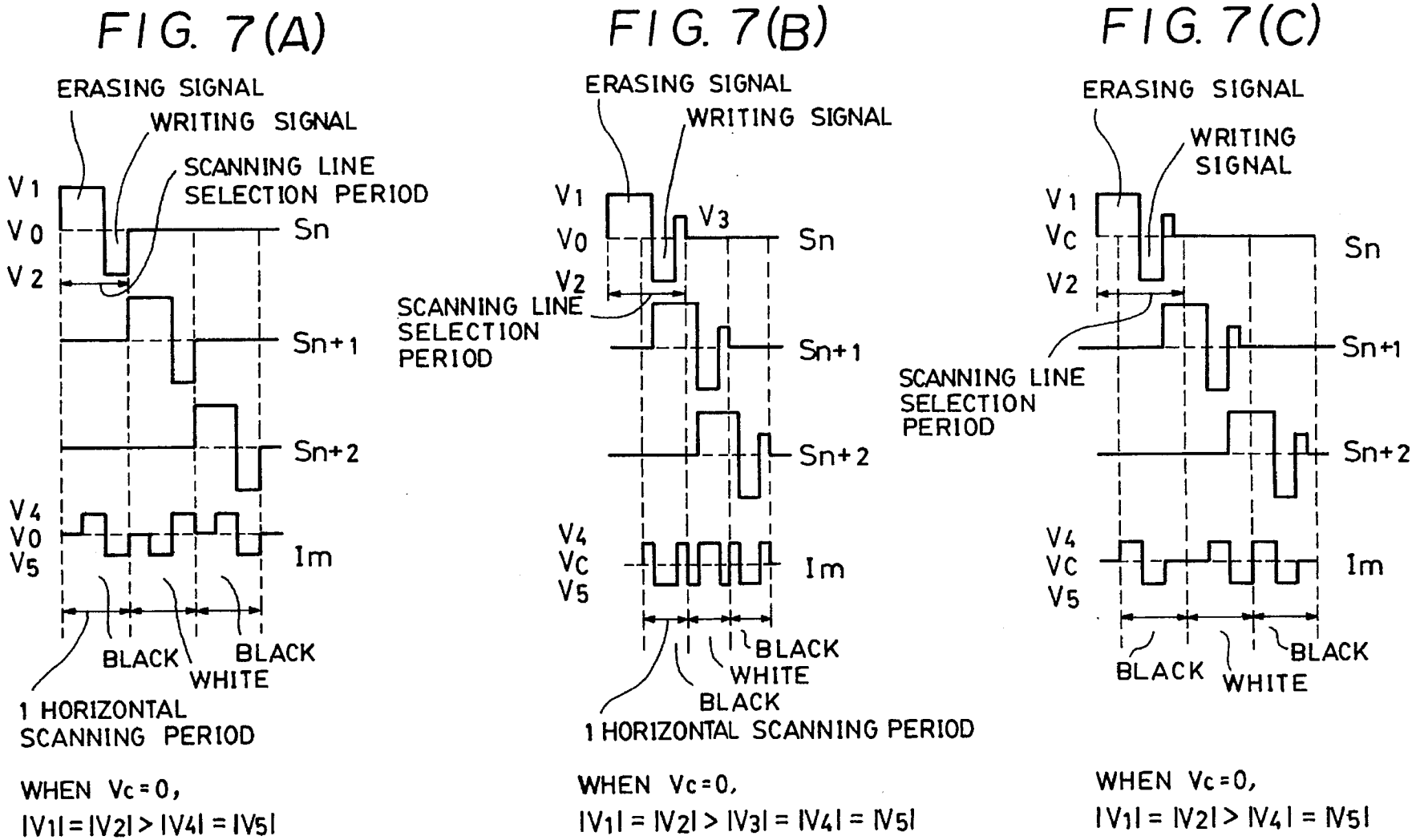
FIG. 7(A)
ERASING SIGNAL
WRITING SIGNAL
SCANNING LINE SELECTION PERIOD
Sn
Sn+1
Sn+2
Im
V1
V0
V2
V4
V0
V5
BLACK
WHITE
BLACK
1 HORIZONTAL SCANNING PERIOD
WHEN Vc=0,
|V1|=|V2|>|V4|=|V5|
FIG. 7(B)
ERASING SIGNAL
WRITING SIGNAL
V3
Sn
Sn+1
Sn+2
Im
V1
V0
V2
V4
Vc
V5
SCANNING LINE SELECTION PERIOD
BLACK
WHITE
BLACK
1 HORIZONTAL SCANNING PERIOD
WHEN Vc=0,
|V1|=|V2|>|V3|=|V4|=|V5|
FIG. 7(C)
ERASING SIGNAL
WRITING SIGNAL
Sn
Sn+1
Sn+2
Im
V1
Vc
V2
V4
Vc
V5
SCANNING LINE SELECTION PERIOD
BLACK
WHITE
BLACK
WHEN Vc=0,
|V1|=|V2|>|V4|=|V5|

DISPLAY APPARATUS

This application is a continuation of application Ser. No. 07/603,375 filed Oct. 26, 1990, now abandoned.

BACKGROUND OF THE INVENTION

1. Field of the Invention

The present invention relates to liquid crystal display devices, and more particularly, to display devices having a memory effect, such as ferroelectric liquid crystal panels.

2. Description of the Related Art

In previous ferroelectric liquid crystal panels described in, for example, U.S. Pat. Nos. 4,655,561, 4,836,656 and 4,844, 590, a desired screen is written by selectively applying to each pixel on a selected scanning line at two different phases a voltage having one polarity and a voltage having the other polarity which are high enough to switch a pixel.

Thus, writing is conducted on the ferroelectric liquid crystal panel in accordance with the polarity of a DC pulse which is applied to the liquid crystal. It is therefore necessary for a voltage having one polarity and a voltage having the other polarity to be applied by both a scanning driving circuit for driving scanning lines and a data line driving circuit for driving data lines using a predetermined voltage as a reference. In an example of the driving method shown in FIG. 6, $V_1$ (36 volts), $V_2$ (0 volts) and $V_c$ (18 volts) are supplied to the scanning line driving circuit while $V_3$ (24 volts), $V_4$ (12 volts) and $V_c$ (18 volts) are supplied to the data line driving circuit.

The voltages supplied to the driving circuits, such as voltages $V_1$ to $V_4$ and $V_c$, are generally generated on the basis of power supplied from an external power source of 100 volts (as used in Japan), 110 volts (as used in the United States), or a battery power source. The present inventors conducted experiments and found that DC voltages are applied irregularly to the liquid crystal due to a difference in the time constant between the scanning line driving circuit and the data line driving circuit. This difference in the time constant results in an image disturbance of a few (i.e., one to two) seconds immediately after the voltage supply to the scanning line driving circuit and the data line driving circuit is interrupted (i.e., power is turned off) during a writing period during which refresh (i.e., repetitive) scanning is performed on the display panel. In particular, the present inventors discovered that a DC voltage is supplied to the liquid crystal on a writing scanning line immediately before the power is turned off which is sufficiently large to disturb the uniform orientation of the liquid crystal along that scanning line.

Furthermore, it is commonly understood that a scanning signal having one polarity pulse for erasing the written state of a pixel and other polarity pulse is used advantageously in ferroelectric liquid crystal panel driving methods because it provides a sufficient driving margin, assures a fast screen rewriting speed and can be implemented by a simple control system. However, such a driving margin changes with time, as described below.

SUMMARY OF THE INVENTION

An object of the present invention is to provide a display panel which eliminates image disturbance from a display panel, even when power is turned off during a writing period in which refreshing scanning or the like is performed on the display panel, and which enables uniform orientation of a ferroelectric liquid crystal to be maintained sufficiently.

Another object of the present invention is to provide a display device which increases the driving margin when the power is turned off.

The present invention provides in one aspect a display device which includes a display panel having a matrix electrode arrangement of intersecting scanning and data lines, a driving voltage generating means for supplying voltages to be applied to scanning lines to a scanning line driving means for driving scanning lines, as well as voltages to be applied to data lines to a data line driving means for driving data lines, wherein at least one voltage level is supplied to both the scanning and the data line driving means, a switching means for turning on or off an electrical connection between the driving voltage generating means to a power source for supplying or disconnecting power to the driving voltage generating means, and a control means for controlling the scanning and data line driving means such that a scanning signal voltage is applied to the scanning lines to scan the same while a data signal voltage corresponding to image data is applied to the data lines when the switching means is on, such that the same level voltage supplied to the scanning and data line driving means is applied to the scanning lines and to the data lines after the switching means is turned off. In a preferred form, the display panel has a memory effect, such as a ferroelectric liquid crystal panel.

The present invention provides in another aspect a display device which includes a display panel having a matrix electrode arrangement of intersecting scanning lines and data lines, a driving voltage generating means for supplying voltages to be applied to scanning lines to a scanning line driving means for driving scanning lines, as well as voltages to be applied to data lines to a data line driving means for driving data lines, wherein at least one voltage level is supplied to both the scanning and the data line driving means, a switching means for turning on or off an electrical connection between the driving voltage generating means to a power source for supplying or disconnecting power to the driving voltage generating means, and a control means for controlling the scanning and data line driving means such that a scanning signal having one polarity pulse is applied to selected scanning lines to erase a writing state of pixels while a data signal corresponding to image data is applied to the data lines when the switching means is on, such that a voltage sufficient to erase the display condition of the display panel which is the same polarity pulse as the one polarity pulse is applied to the scanning lines after the switching means is turned of, wherein a voltage applied to the scanning non-selected electrodes is used as a reference of polarity.

BRIEF DESCRIPTION OF THE DRAWINGS

FIGS. 6 and 7(A) to (C) show driving waveforms employed in the present invention.

DETAILED DESCRIPTION OF THE PREFERRED EMBODIMENTS

The present invention will now be described in detail with reference to the accompanying drawings.

Figure 1:
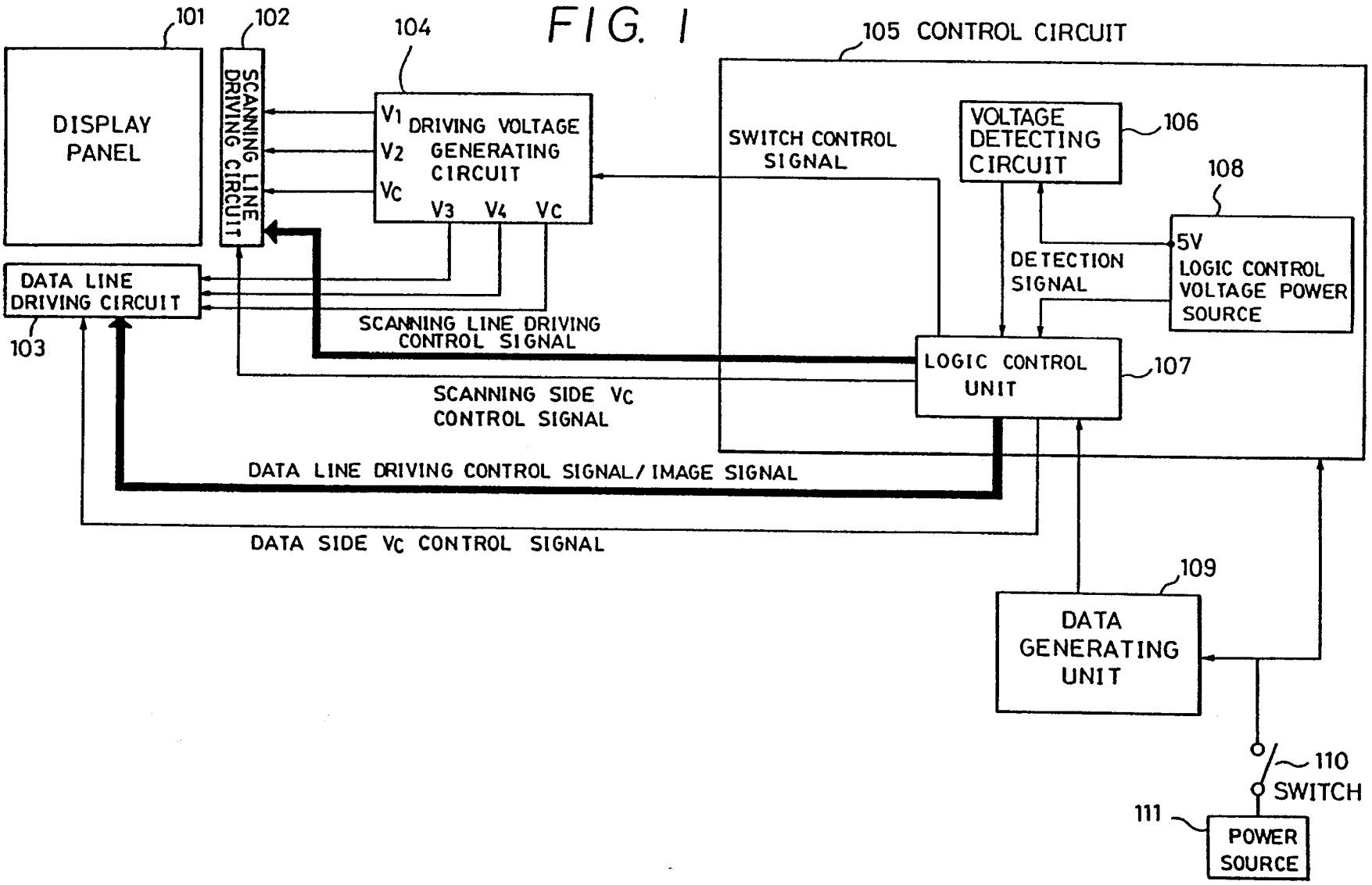
FIG. 1 is a block diagram of a display device according to the present, invention.

FIG. 1 is a block diagram of an embodiment of a display device according to the present invention. The display device includes a display panel 101 which employs a conventional matrix electrode arrangement (not shown) formed by scanning lines and data lines and a ferroelectric liquid crystal, a scanning line driving circuit 102 for driving the scanning lines, a data line driving circuit 103 for driving the data lines, a driving voltage generating circuit 104 for supplying voltages $V_1$, $V_2$ and $V_c$ to scanning line driving circuit 102 and voltages $V_3$, $V_4$ and $V_c$ to data line driving circuit 103, a control circuit 105 for controlling scanning line driving circuit 102, data line driving circuit 103 and the driving voltage generating circuit 104, a voltage detecting circuit 106 for detecting the electrical interruption of switch 110 (i.e., the interruption of supply of power from power source 111), a logic control circuit 107, a logic control voltage source 108, and a data generating unit 109 to output a detection signal.

The logic control circuit 107 outputs a switch control signal to activate a switching element 33 provided in the driving voltage generating circuit 104 (described below) and thereby output a grounded potential, a scanning side $V_c$ control signal to control a switching array 21 in the scanning line driving circuit 102 (such that it is connected to a voltage $V_c$ line from the driving voltage generating circuit 104 and thereby outputs only a voltage $V_c$ from the scanning line driving circuit 102 after the switch 110 is turned off), a scanning line driving control signal to control the switching array 21 (such that it outputs to a selected scanning line a scanning selection signal consisting of voltages $V_1$ and $V_2$, and to a non-selected scanning line a voltage $V_c$ shown in FIG. 6), a data side $V_c$ control signal to control a switching array 22 in the data line driving circuit 103 (such that it is connected to the voltage $V_c$ line from the driving voltage generating circuit 104 and thereby outputs only the voltage $V_c$ which has the same level as the voltage $V_c$ after the switch 110 is turned off), a data line driving control signal to control the switching array 22 (such that it selectively outputs to the data lines an image signal corresponding to the image data from the data generating circuit 109 as well as a white data signal voltage and a black data signal voltage shown in FIG. 6, consisting of voltages $V_3$, $V_4$ and $V_c$ based on the image signal), and an image signal.

Figure 2:
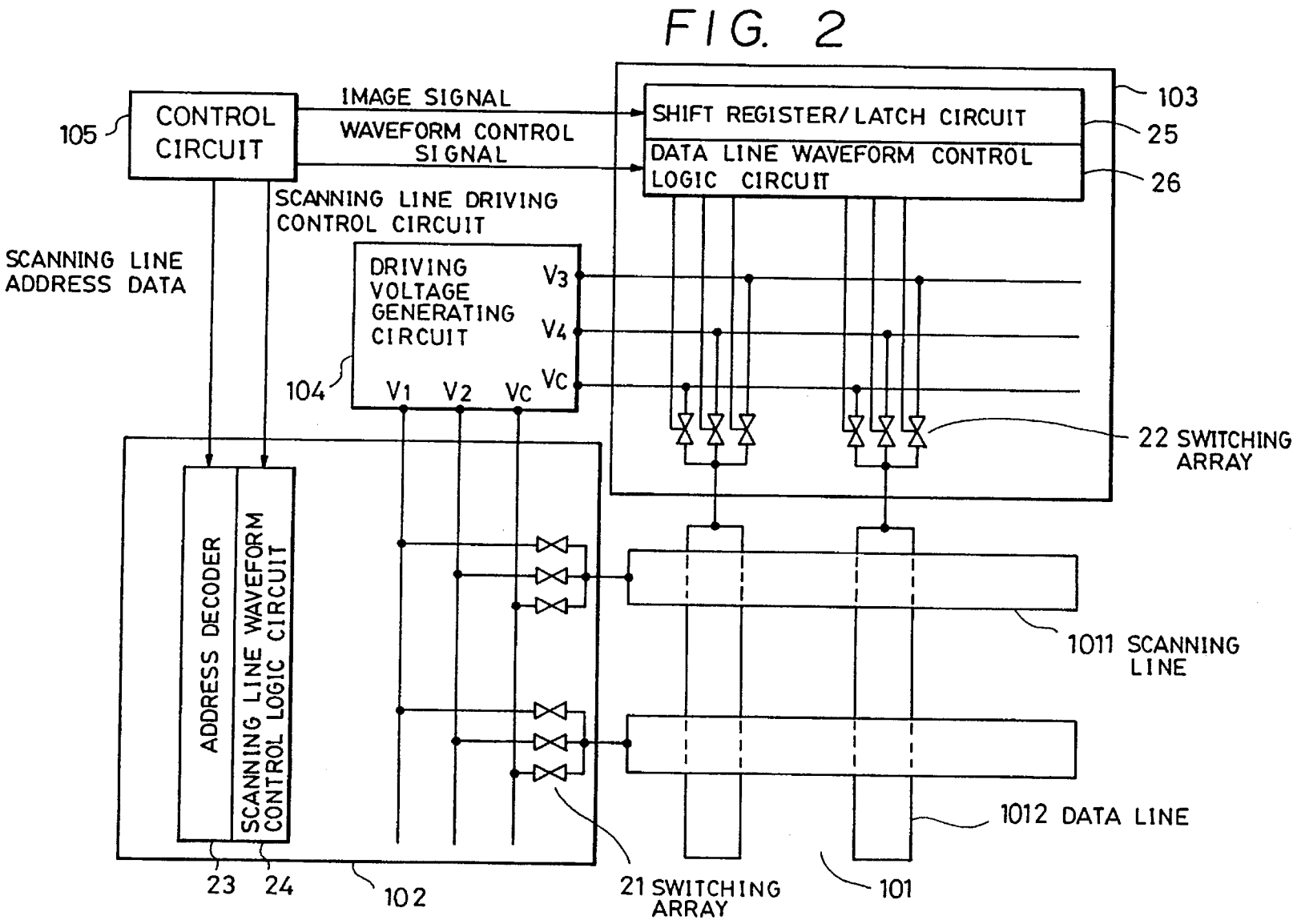
FIG. 2 is a block diagram of a driving circuit employed in the present invention.

FIG. 2 is a block diagram of the scanning line driving circuit 102 and the data line driving circuit 103. The scanning line driving circuit 102 includes an address decoder 23 for decoding the scanning line address data in the scanning line driving control signal and a scanning waveform control logic circuit 24 for activating the switching array 21 such that it outputs the scanning selection signal shown in FIG. 6 to respective scanning lines 1011 in sequence.

Figure 6:
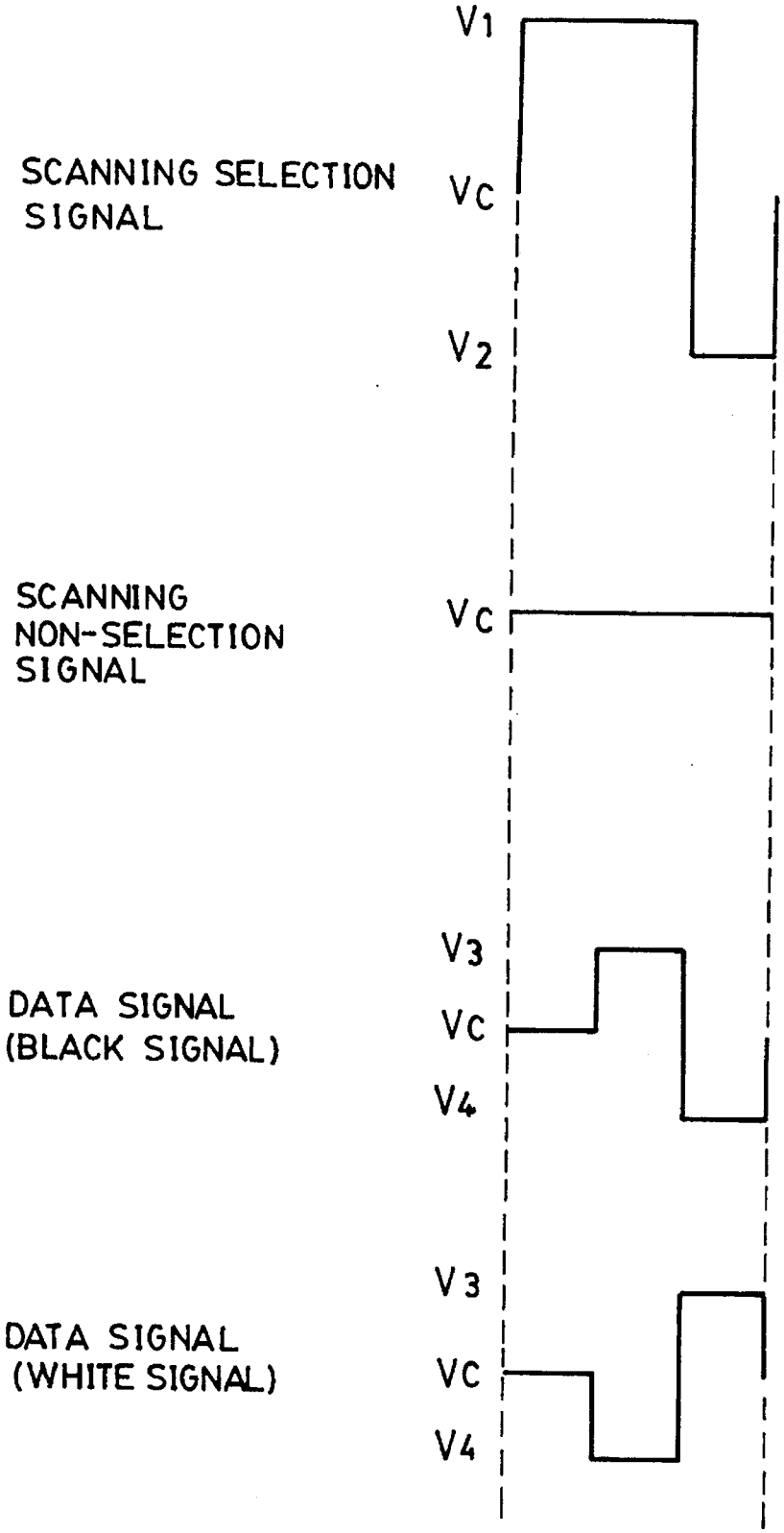

The data line driving circuit 103 includes a shift register/latch circuit 25 for converting a serial image signal into a parallel image signal, and a data line waveform control logic circuit 26 for generating a data signal voltage shown in FIG. 6 in accordance with the image data and for activating the switching array 22 such that it outputs the image signal voltage to a data line 1012.

Figure 3:
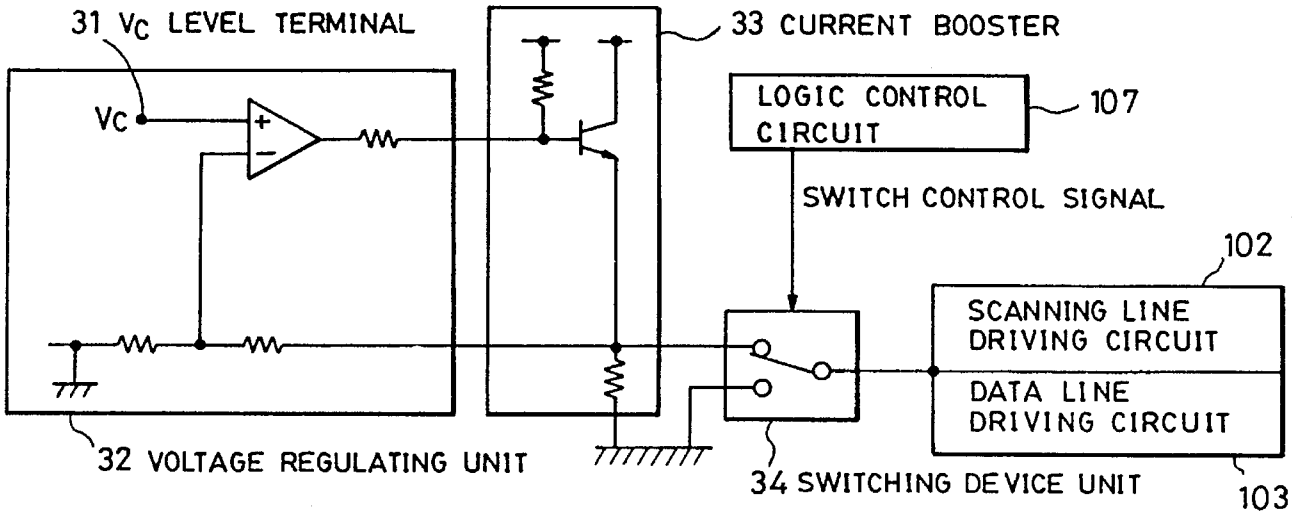
FIG. 3 is a circuit diagram of an output stage of a $V_c$ power line employed in the present invention.

FIG. 3 is a circuit diagram of the driving voltage generating circuit 104 showing the output stage of the voltage $V_c$. The driving voltage generating circuit 104 includes a terminal which assumes a voltage $V_c$ level, a voltage regulator 32, a current booster 33, and a switching device 34 for connecting either the voltage $V_c$ or a grounded potential to the scanning line driving circuit 102 and to the data line driving circuit 103 in accordance with the switch control signal from the logic control unit 107.

Figure 4:
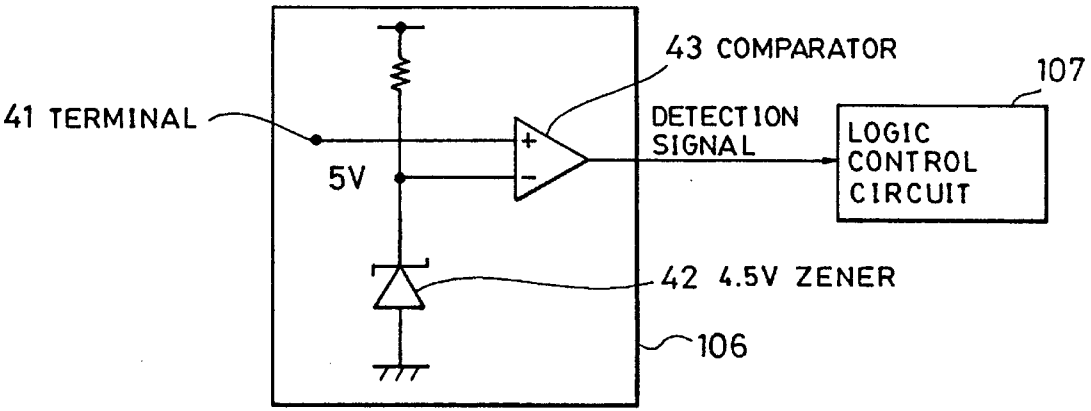
FIG. 4 is a circuit diagram of a voltage detecting circuit employed in the present invention.

FIG. 4 is a circuit diagram of the voltage detecting circuit 106. A terminal 41 of the voltage detecting circuit 106 is connected to the logic control voltage source 108. The voltage detecting circuit 106 includes a 4.5 volts Zener 42 and a comparator 43. The voltage detecting circuit 106 outputs its logical low or high detection signal to the logic control circuit 107.

Figure 5A:
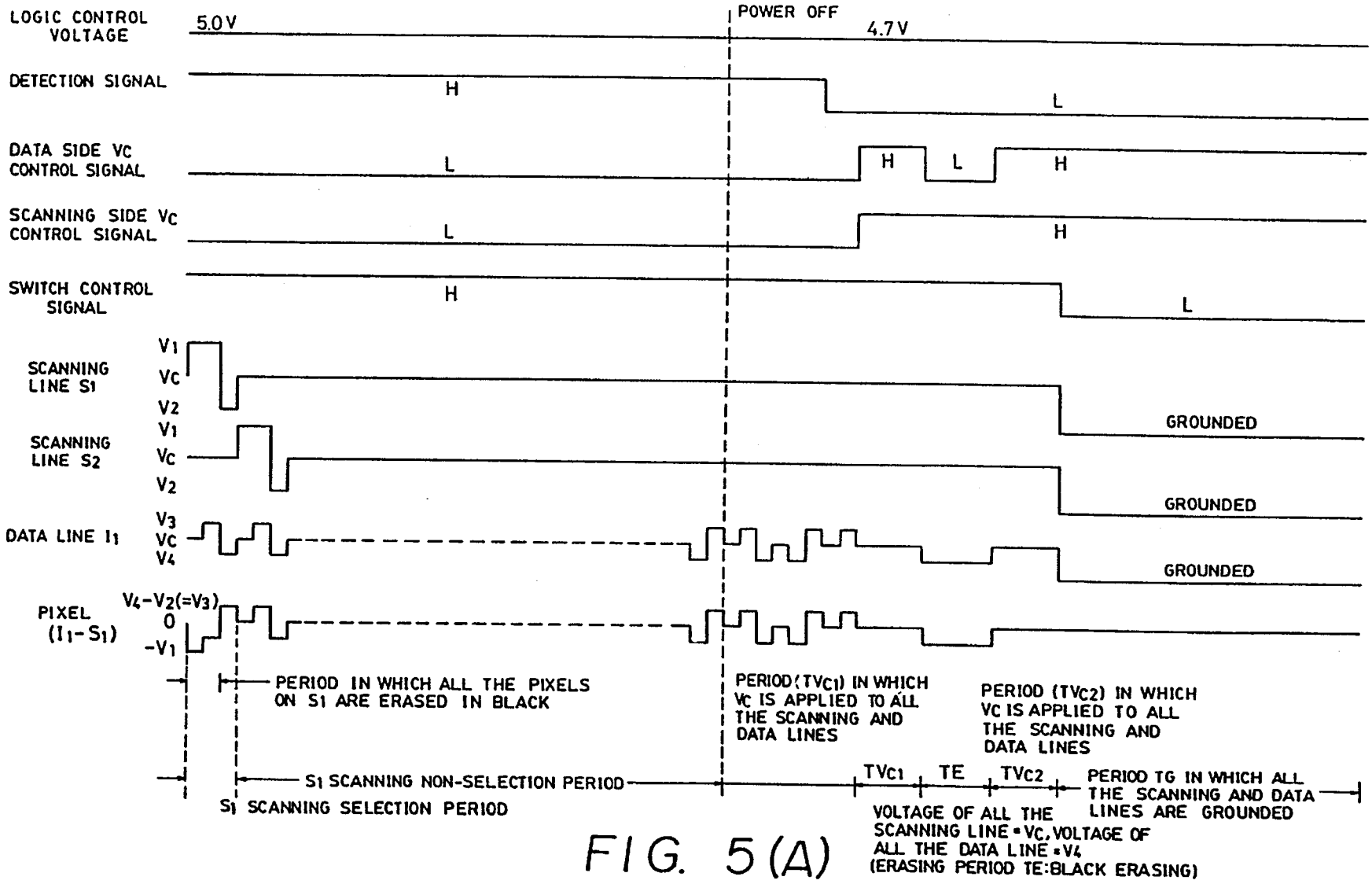
FIG. 5(A) is a timing chart showing a time series state of the display device according to the present invention.
Figure 5:
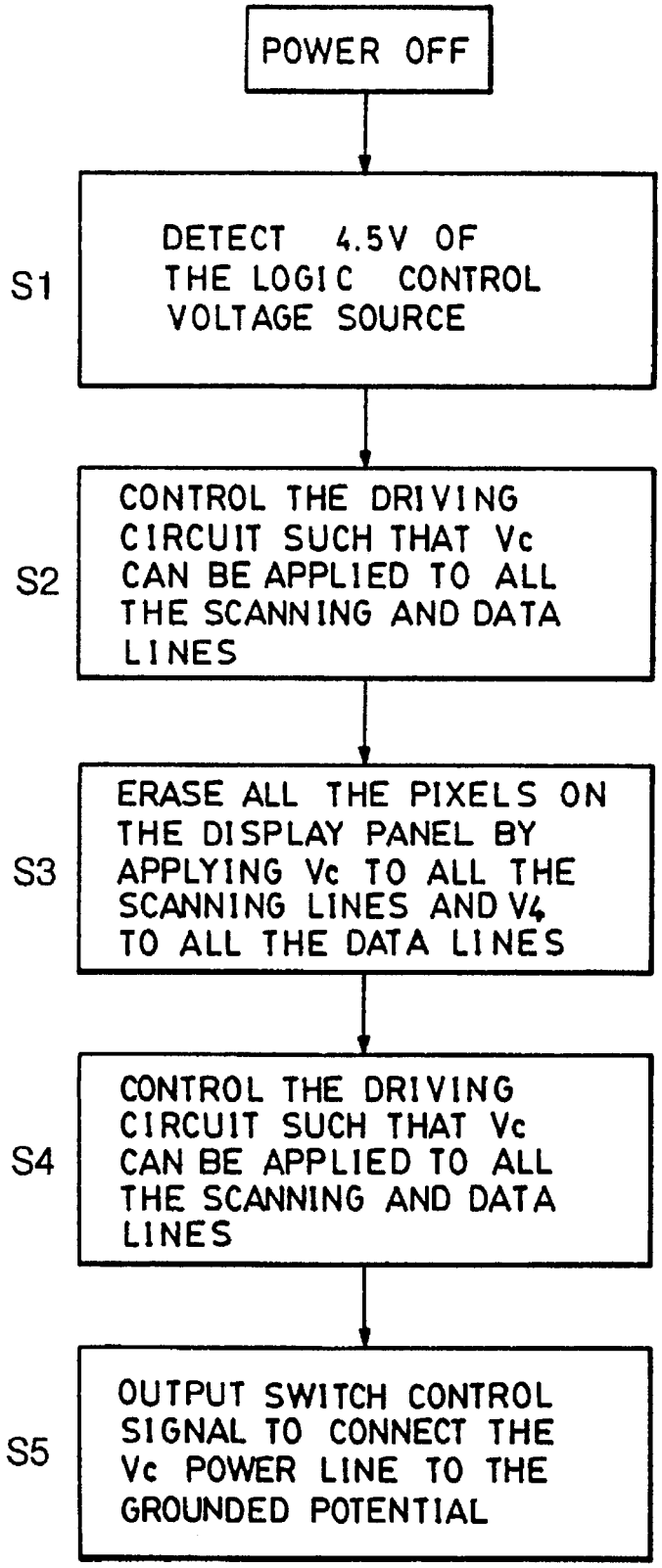
FIG. 5(B) is a flowchart showing the operation of a display device according to the present invention.
FIG. 5(C) is a timing chart showing another time series state of the display device according to the present invention.
Figure 5:
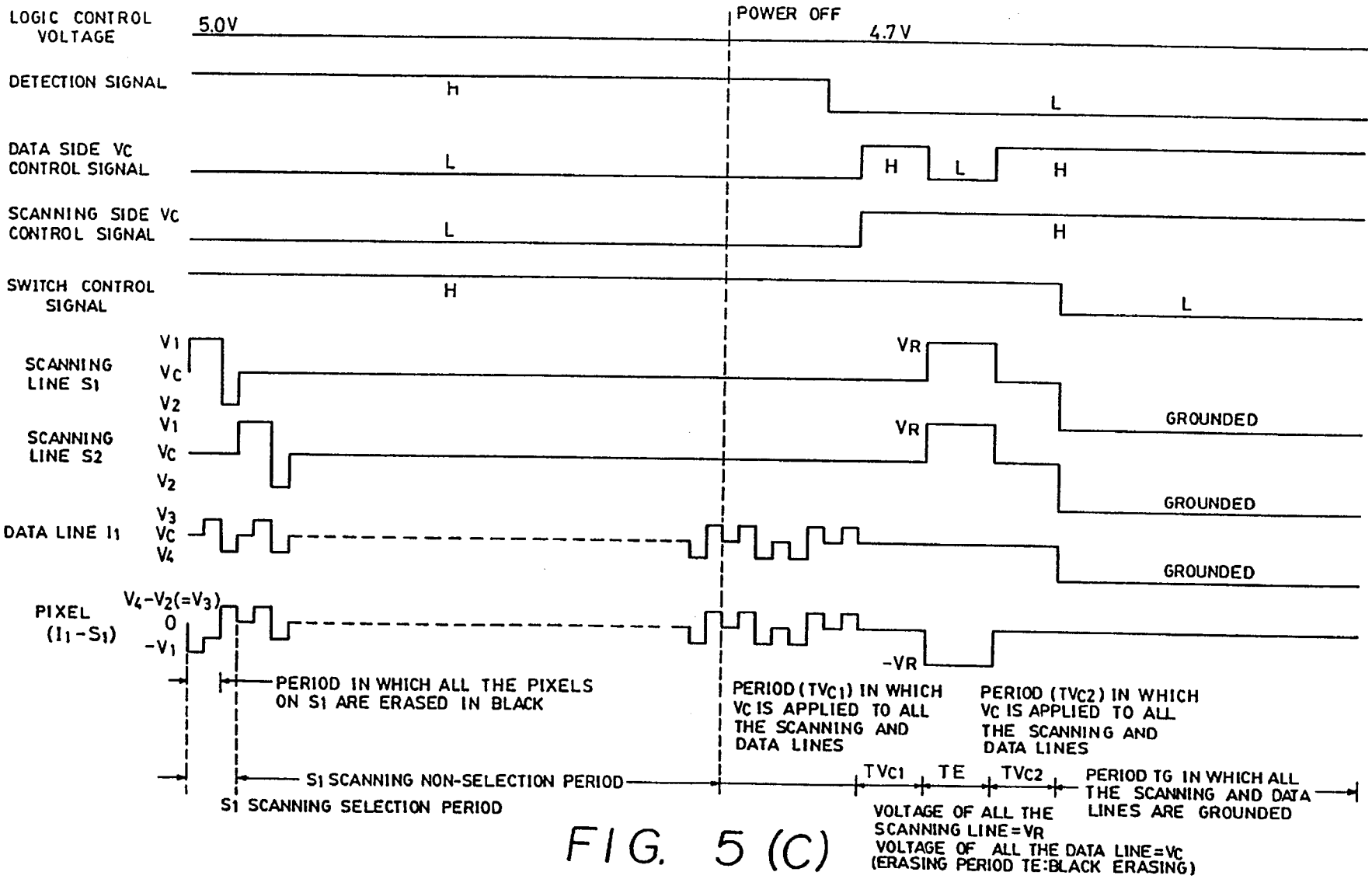

FIG. 5(A) is a timing chart showing on a time series basis (t:time) an output level of the logic control voltage source 108, the detection signal, an output level of the scanning line side output stage and an output level of the data line side output stage of the driving voltage generating circuit 104, an output level of the switch control signal, an output level of the output stage of the scanning line driving circuit 102 (e.g., a level of the output to the scanning lines $S_1$ and $S_2$), an output level of the output stage of the data line driving circuit 103 (e.g., an level of the output to the data line $I_1$), and a voltage level at a pixel ($I_1$_$S_1$) at an intersection of the scanning line $S_1$ and the data line $I_1$. The signals shown in FIG. 5(A) are obtained by using a waveform shown in FIG. 7(A).

As shown in FIG. 5(A) and described in the flow chart of FIG. 5(B), in step (2). The logic control circuit 107 outputs a scanning side Vc control signal and a data side $V_c$ control signal to the driving circuits 102 and 103, respectively, such that the output stage thereof outputs a voltage $V_c$ several μsec after the logic control circuit receives a detection signal from the voltage detecting circuit 106 in step (1). Thereafter, in step (3) the logic control circuit 107 outputs a control signal to activate the switching array 21 of the scanning line driving circuit 102 such that the switching array 21 outputs the voltage $V_c$ to all the scanning lines and outputs a control signal to activate the switching array 22 of the dataline driving circuit 103 such that the switching array 22 outputs a voltage $v_4$ to all the data lines, thereby erasing the screen of the display panel 101 in white or black over the several tens to several hundreds of μsec. Thereafter, (4) the logic control circuit 107 outputs a control signal to control the driving circuits 102 and 103 such that the driving circuits 102 and 103 output only a voltage $V_c$ over the several μsec. Thereafter, in step (5) the logic control circuit 107 outputs a switch control signal to the driving voltage generating circuit 104 to activate the switching element 34 and thereby connect the voltage $V_c$ output stage in the driving voltage generating circuit 104 to a grounded potential.

In step (3) of the flowchart of FIG. 5(B), all the display contents which are written by the refresh scanning of the display panel 101 after power is turned off are erased in order to eliminate storage of the contents displayed on the display panel 101 after the power off.

FIG. 5(C) is a timing chart of another embodiment of the present invention. The timing chart shown in FIG. 5(C)

differs from that shown in FIG. 5(A) in that it has an erasing period $T_E$. In the erasing period $T_E$, an erasing voltage having the same polarity as that of the erasing signal voltage is applied to all the scanning lines. The erasing voltage $V_R$ may be applied to the scanning lines concurrently, as shown in FIG. 5(C), or sequentially for each scanning line.

Figure 8:
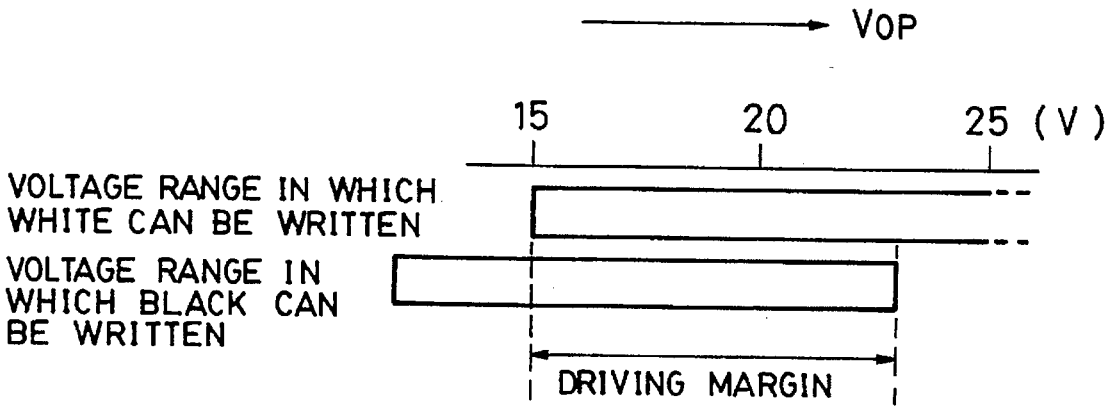
FIGS. 8(A) to (B) schematically show driving margins.
Figure 8:
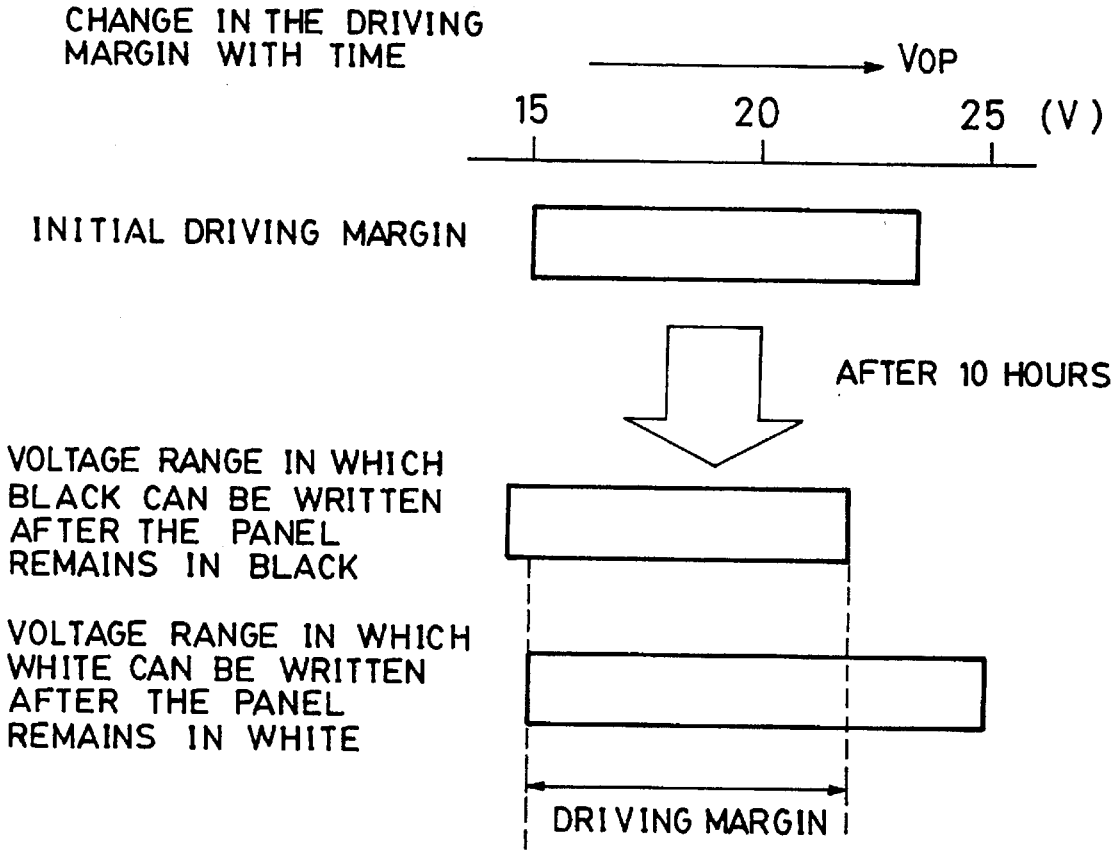

FIG. 8(A) shows examples of voltage ranges (driving margins) in which "white" (light state) and "black" (dark state) can be written on the display panel in accordance with the image data when driving waveforms shown in FIG. 7 and the timing chart shown in FIG. 4(C) are used. The voltage range in which "black" can be written is $V_{OP}$ ($V_{OP=V4-V2}$), the voltage range in which "white" can be written is $V_{OP}$ ($V_{OP=Vs-V2}$), and an overlapping range which is the driving margin when the driving waveforms shown in FIG. 7(A) are used and when one horizontal scanning period is 240 μsec (in FIG. 7(A), $|V_4|=|V_5|$).

FIG. 8(B) shows a change in driving margin with time. That is, FIG. 8(B) shows the driving margin when the drive starts after the display panel is left unused for ten hours. As can be seen in FIG. 8(B), the voltage range in which "black" can be written after the panel remains in black for ten hours decreases as does the voltage range in which "white" can be written after the panel remains in white for ten hours. The overlapping driving margin thereby decreases. It is possible according to the present invention to eliminate decrease in the driving margin with time.

FIGS. 7(A) to (C) show examples of waveforms which are employed in the present invention. In FIGS. 7(A) to (C), $S_n$, $S_{n+1}$, $S_{n+2}$. . . respectively denote the nth scanning (n: an integer) line, the n+1th scanning line, the n+2th scanning line. $I_m$ denotes the mth data line. The voltage waveform applied in the scanning selection period is a scanning selection signal. A desired scanning line is selected by applying the scanning selection signal. "Erasing signal" in the scanning selection signal has a voltage sufficient to erase the written state of a pixel in spite of the data signal. "Writing signal" is a combination of data signal and voltages $V_4$ and $V_5$ and determines the written state. A grounded voltage $V_c$ is applied to the non-selected scanning electrodes to which a scanning selection signal is not applied. "Black" and "white" respectively denote the waveform of a black data signal and the waveform of a white data signal.

In addition to the driving waveforms shown in FIGS. 7(A) to (C), those disclosed in U.S. Pat. Nos. 4,655,561 and 4,836,656 can also be used in the present invention.

Table 1 shows driving margins obtained when the display panel is driven using the driving waveforms shown in FIGS. 7(A) to (C).

TABLE 1

| Example | Driving waveform | Driving margin after ten hours |
|---|---|---|
| 1 | FIG. 7 (A) one horizontal scanning period: 240 μsec | 19.5 to 21 volts |
| 2 | FIG. 7 (B) one horizontal scanning period: 160 μsec | 20 to 22.5 volts |
| 3 | FIG. 7 (C) one horizontal scanning period: 240 μsec | 19.5 to 21.5 volts |

According to the present invention, it is possible to ensure a sufficient driving margin when the display panel is driven after it is left unused for a long time. Furthermore, it is possible to restrict the generation of image disturbances which occur when the power is turned off. In particular, it is possible to eliminate or sufficiently decrease the application of a high DC voltage to the pixels on the writing scanning line immediately after power is turned off. This keeps the liquid crystal in a uniform orientation. Ferroelectric liquid crystal display panels disclosed, for example, in U.S. Pat. Nos. 4,639,089, 4,709,994, 4,712,973 and 4,712,874 and the active matrix liquid crystal display panel which employs thin film transistors as switching elements for pixels, disclosed in, for example, U.S. Pat. No. 4,697,887, can be employed as the display panel 101 of this invention, particularly, those which have the memory effect.

What is claimed is:

1. A display apparatus comprising:

a liquid crystal display device having a memory property comprising a plurality of picture elements, each picture element including a liquid crystal material disposed between a respective pair of electrodes;

detecting means for detecting whether a predetermined power level is being applied to said display apparatus;

erasing means for applying a non-zero erasing signal to said liquid crystal device for erasing display contents of said picture elements; and setting means for setting all of the pairs of electrodes corresponding to the picture elements to a substantially same electric potential, wherein said setting means sets all the pairs of electrodes to the substantially same electric potential before said erasing means applies the erasing signal, in accordance with a detection of said detecting means.

2. An apparatus according to claim 1, wherein said liquid crystal display device comprises an active matrix liquid crystal device.

3. An apparatus according to claim 1, wherein said liquid crystal display device comprises a ferroelectric liquid crystal device.

4. An apparatus according to claim 1, wherein said detecting means comprises a switch for cutting off an electrical connection between a power source and said apparatus, and a detecting circuit for detecting a cutoff-state of said switch.

5. An apparatus according to claims 4, wherein said detecting circuit generates a detecting signal when a voltage of the power source declines below a predetermined voltage.

6. An apparatus according to claim 1, wherein said picture elements are arranged in a matrix of scanning lines and data lines perpendicular thereto, and wherein said erasing means causes the liquid crystal material for all the picture elements to assume a same orientation state by applying a first voltage to all the scanning lines of said liquid crystal display device and a second voltage to all the data lines for a predetermined period.

7. An apparatus according to claim 1, wherein said picture elements are arranged in a matrix of scanning lines and data lines perpendicular thereto, and wherein said setting means supplies a reference voltage to all the scanning lines and all the data lines from a circuit for generating a driving voltage.

8. An apparatus according to claim 7, wherein said circuit for generating a driving voltage also generates a plurality of driving signals for performing a display operation.

9. An apparatus according to claim 1, wherein said picture elements are arranged in a matrix of scanning lines and data lines perpendicular thereto, said apparatus further comprising:

scanning line and data line drivers connected with a driving voltage generator for generating a reference voltage, wherein said setting means supplies a command to the scanning line and data line drivers to supply the reference voltage to all the scanning lines and all the data lines.

10. An apparatus according to claim 1, wherein said liquid crystal display device further comprises a circuit for forming data to be displayed when said apparatus is in a power-on state.

11. A method for controlling a liquid crystal display device provided with a detecting means for detecting whether a predetermined power level sufficient for a display operation is being applied to the display device, said device including a plurality of picture elements having a memory property for performing display, each picture element capable of exhibiting either of two display states in accordance with an electric field applied thereto, said method comprising the steps of:

setting all the picture elements in a state in which no electric field is applied thereto after interruption of the predetermined power level, in accordance with a detection of the detecting means; and thereafter applying a non-zero electric field to all the picture elements, in accordance with the detection of said detecting means, to cause all the picture elements to uniformly exhibit one of the two display states after the interruption of the predetermined power level.

12. An apparatus for driving a liquid crystal display device including a plurality of picture elements having a memory property for performing display, each of said picture elements disposed between a pair of electrodes, said apparatus comprising:

detecting means for detecting whether a predetermined power level is being applied to said apparatus;

erasing means for applying a non-zero erasing signal to said liquid crystal device for erasing display contents of said picture elements; and setting means for setting all of the pairs of electrodes corresponding to the picture elements to a substantially same electric potential, wherein said setting means sets all the pairs of electrodes to the substantially same electric potential before the erasing means applies the erasing signal, in accordance with a detection performed by said detecting means.

* * * * *

UNITED STATES PATENT AND TRADEMARK OFFICE

CERTIFICATE OF CORRECTION

PATENT NO. : 5,592,191

DATED : January 7, 1997

INVENTOR(S) : AKIRA TSUBOYAMA, ET AL.

It is certified that error appears in the above-identified patent and that said Letters Patent is hereby corrected as shown below:

On the title page, item

[56] REFERENCES CITED

U.S. Patent Documents
Insert: --5,013,137 5/1991 Tsuboyama et al. ... 350/333--.

[56] REFERENCES CITED

Foreign Patent Documents
Insert: --286309 10/1988 European Pat. Off. G09G 3/36
316801 5/1989 European Pat. Off. G09G 3/36
3630012 4/1987 German G02F 1/137--.

COLUMN 2

Line 49, "of," should read --off,--.
Line 56, "present," should read --present--.

COLUMN 4

Line 31, "an" should read --a--.
Line 32, "$(I_1_S_1)$" should read --$(I_1-S_1)$--.
Line 38, "Vc" should read --$V_c$--.
Line 47, "dataline" should read --data line--.
Line 49, "$v_4$" should read --$V_4$--.
Line 51, "(4)" should read --in step (4)--.

UNITED STATES PATENT AND TRADEMARK OFFICE

CERTIFICATE OF CORRECTION

PATENT NO. : 5,592,191

DATED : January 7, 1997

INVENTOR(S) : AKIRA TSUBOYAMA, ET AL.

It is certified that error appears in the above-identified patent and that said Letters Patent is hereby corrected as shown below:

COLUMN 5

Line 10, "FIG. 4(C)" should read --FIG. 5(C)--.
Line 12, "($V_{OP=V4-V2}$)," should read --$V_{OP}$= $V_4$-$V_2$),--.
Line 13, "($V_{OP=VS-V2}$)," should read --$V_{OP}$= $V_S$-$V_2$),--.

COLUMN 6

Line 5, "Ferroelectric" should read --¶ Ferroelectric--.

Signed and Sealed this

Twenty-first Day of October 1997

Bruce Lehman

*Attest:*

BRUCE LEHMAN

*Attesting Officer*

*Commissioner of Patents and Trademarks*